US007207849B2

(12) United States Patent
Zinn

(10) Patent No.: US 7,207,849 B2
(45) Date of Patent: Apr. 24, 2007

(54) ELECTRICAL CONTACT ELEMENT AS WELL AS CONTACTING DEVICE HAVING A CONTACT ELEMENT

(75) Inventor: Bernd Zinn, Ennepetal (DE)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 11/314,205

(22) Filed: Dec. 20, 2005

(65) Prior Publication Data

US 2006/0211310 A1 Sep. 21, 2006

(30) Foreign Application Priority Data

Dec. 27, 2004 (DE) ..... 10 2004 062 879

(51) Int. Cl.
*H01R 13/187* (2006.01)

(52) U.S. Cl. ..... 439/844

(58) Field of Classification Search ..... 439/816, 439/817, 823, 828, 834, 839, 842, 844, 853, 439/856, 857, 858, 861, 81, 82, 83, 342
See application file for complete search history.

(56) References Cited

U.S. PATENT DOCUMENTS 5,061,379 A * 10/1991 White ..... 210/767
5,188,535 A * 2/1993 Bertho et al. ..... 439/83
5,597,332 A * 1/1997 Walbrecht ..... 439/850
5,609,495 A * 3/1997 McHugh ..... 439/268
5,616,044 A * 4/1997 Tsai ..... 439/342
5,679,010 A * 10/1997 Hotea et al. ..... 439/81
6,093,053 A * 7/2000 Horioka et al. ..... 439/444
6,193,567 B1 * 2/2001 Hsieh ..... 439/853
6,371,784 B1 * 4/2002 Scholz et al. ..... 439/342
6,471,534 B1 * 10/2002 Lee ..... 439/342
6,533,591 B1 * 3/2003 Lee ..... 439/83
6,554,633 B1 * 4/2003 Nobuyuki et al. ..... 439/342
6,824,414 B2 * 11/2004 Whyne et al. ..... 439/342
7,074,055 B2 * 7/2006 Yang et al. ..... 439/83
2003/0013330 A1 * 1/2003 Takeuchi ..... 439/83

* cited by examiner

*Primary Examiner*—Ross Gushi
(74) *Attorney, Agent, or Firm*—Brooks Kushman P.C.

(57) ABSTRACT

The invention relates to an electrical contact element made out of a stamped sheet metal part, a one-piece combination of an edgewise-wound spring element that is resilient about an axis lying perpendicular to the plane of the sheet metal with a leaf spring-like flat spring element that is connected to the edgewise-wound spring element and that is resilient about an axis lying in the plane of the sheet metal, the plane of the sheet metal of the flat spring element being oriented perpendicular to the plane of the sheet metal of the edgewise-wound spring element.

37 Claims, 7 Drawing Sheets

SECTION F/F

ELECTRICAL CONTACT ELEMENT AS WELL AS CONTACTING DEVICE HAVING A CONTACT ELEMENT

BACKGROUND OF THE INVENTION

1. Field of the Invention

The invention relates to an electrical contact element made of a stamped sheet metal part, which is intended to make contact with the electrical conduction path of a printed circuit board. The invention also relates to a contact-making device for servomotors with an adapter board and integrated contact elements in the form of a plug-type connection, for example.

2. Background Art

Contact-making devices for servomotors require a small design, since the servomotors, such as, for example stepper motors, which are used, for example, to operate an indicating instrument, such as a speedometer in a motor vehicle, for example, are themselves miniaturized drive elements, and as a rule only a small amount of space is available for the contact-making device.

The contact-making devices must make contact with correspondingly dimensioned counter contact pins arranged on the servomotor, for example, it being necessary for the point of contact to be vibration resistant and able to cope with relative motions caused by temperature fluctuations, for example, without affecting the transfer of energy.

The only known connections are soldered connections between the servomotor terminals and a printed circuit board, which are costly and require a lot of labor to assemble and repair.

SUMMARY OF THE INVENTION

The goal of the invention is to create a contact element and a plug-in electrical contact-making device to make contact between the servomotor terminals and the conduction paths of a printed circuit board which can withstand high contact forces while remaining vibration resistant and maintaining a secure contact, allow relative large movements at the point of contact without affecting the contact that is made, require little space, and allow simple assembly and repair when servomotors or contact-making devices are defective.

This is accomplished by a contact element having the features of claim 1 and a contact-making device having the features of claim [26].

The invention is explained in detail below using the drawing of a sample embodiment. The figures are as follows:

DETAILED DESCRIPTION OF THE PREFERRED EMBODIMENT

Figure 1:
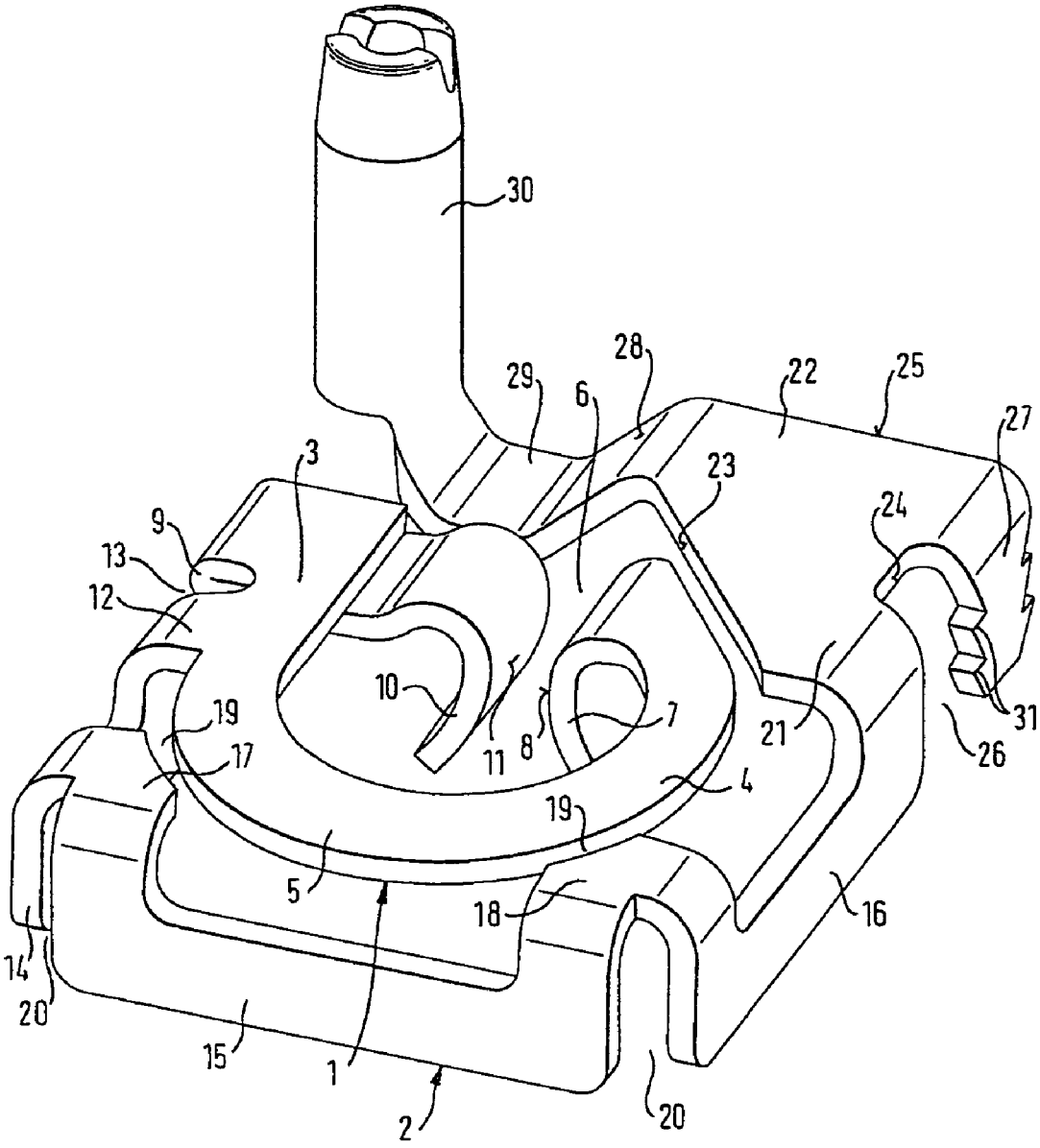
FIG. 1. is a perspective top view of an inventive contact element.
Figure 2:
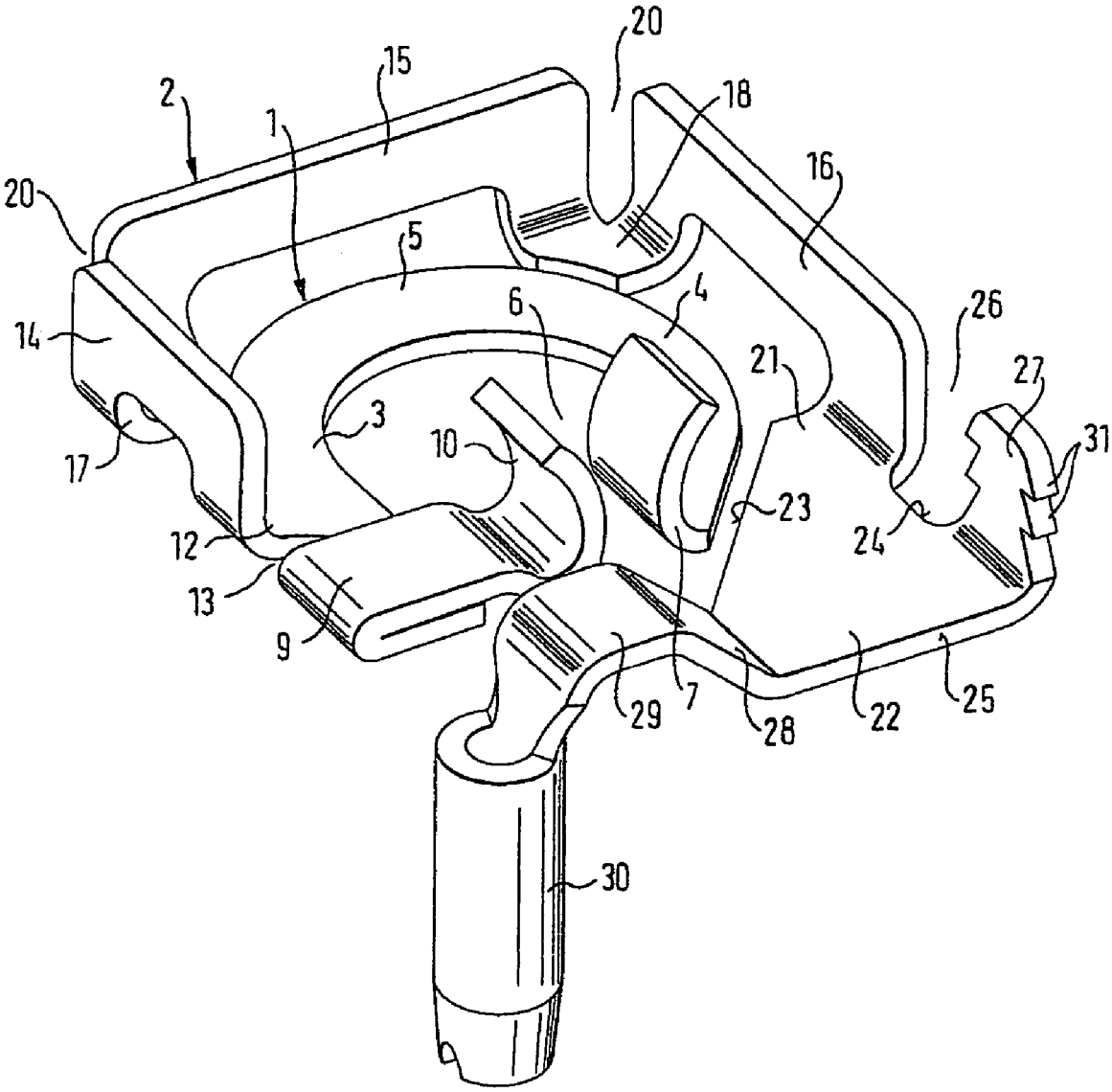
FIG. 2. is a perspective bottom view of the inventive contact element shown in FIG. 1.

FIGS. 1 and 2 show an inventive contact element made of a stamped sheet metal part, which consists essentially of an edgewise-wound spring element 1 and a flat spring element 2 that is connected to it.

The edgewise-wound spring element 1 has, in the plane of its sheet metal, two spring arms 3, 4, arranged at a distance from one another, a spring arm base 5 connecting the spring arms, and, opposite the spring arm base 5, a plug-in gap 6 for a mating connector pin or a mating connector stud (not shown).

It is preferable for the edgewise-wound spring element 1 to be arc-shaped, at least in the area of the spring arm base, the one spring arm 4 continuing to be arc-shaped all the way to plug-in gap 6, while the other spring arm 3 extends away from the spring arm base 5 in a straight line.

In the plug-in gap 6, the free end 7 of spring arm 4 is bent out of the plane of the sheet metal in the shape of a convex arc, forming, in the convex arc, a first point of contact 8.

The free end of spring arm 3 has, attached to its outer edge, a contact tab 9 that is bent back 180° out of the plane of edgewise-wound spring element 1 in the direction of plug-in gap 6, so as to come to lie against spring arm 3, the free end 10 of the contact tab 9 being bent in the same direction as the free end 7 of spring arm 4 and also in the shape of a convex arc, forming a second point of contact 11 opposite point of contact 8.

On the outside of spring arm 3 there is, a small distance 13 shortly before contact tab 9, a connection bridge 12 that is bent down at a right angle in the same direction as contact tab 9 and that connects spring arm 3 to flat spring element 2, which, in the example shown, is made of three flat spring bars 14, 15, 16 arranged at right angles to one another, flat spring bar [14] being connected with flat spring bar 15 through a comer connection bridge 17, and flat spring bar 15 being connected with flat spring bar 16 through a comer connection bridge 18.

The flat spring bars 14, 15, 16 together form a U-shaped frame outside the edgewise-wound spring element 1, surrounding the latter; it is expedient for them to be equally wide and each to extend in a plane that is perpendicular to that of the sheet metal of the edgewise-wound spring element 1, the comer connection bridges 17, 18 being arranged in the plane of the sheet metal of the edgewise-wound spring element 1 at a small distance 19 from it, each being bent by 90° to the respective flat spring bar 14, 15 or 15, 16 and changing into the flat spring bars. It is expedient for flat spring bars 15, 16 to be made equally long, while flat spring bar 14 is somewhat shorter.

The fact that flat spring bars 14, 15, 16 are connected among one another through the corner connection bridges 17, 18 means that the flat spring bars are arranged at a distance to one another, with gaps 20 in the corner areas of the frame where they meet.

At the free end of flat spring element 2, that is at the free end of flat spring element 16, there is a connection bridge 21, which is bent at right angles to the free end of the edgewise-wound spring element 1 and which changes into a contact plate 22 arranged in the plane of the sheet metal of the edgewise-wound spring element 1. The contact plate 22 has a diagonally running inner edge 23 that is separated from the spring arm 4 of edgewise-wound spring element 1, a side edge 24 that is parallel to flat spring bar 16, and an outer edge 25 that is parallel to the flat spring bar 15, as well as a front edge 28 extending parallel to the side edge 24.

Accordingly, contact plate 22 has an approximately triangular shape, connection bridge 21 being connected to the side edge 24 and front edge 28 being located in the area in front of plug-in gap 6.

In the direction of outer edge 25, side edge 24 has, connected to it at a distance 26 to connection bridge 21, a retaining tab 27, which is bent at a right angle, like connection bridge 21, and is aligned with flat spring bar 16, being located in the plane of its sheet metal. It is expedient for retaining tab 27 to be shaped like a Christmas tree and have retaining or latching teeth 31 on its longitudinal edges. The front edge 28 has, connected to it through a connection bridge 29, a soldering pin 30, which is arranged perpendicular to the plane of the sheet metal of the edgewise-wound spring element 1, in the direction opposite that of the of the flat spring bar.

It is preferable for connection bridge 29 to be slightly arched in the direction opposite that in which soldering pin 30 extends, so that the connection zone of soldering pin 30 is somewhat stiffened.

A variant of the inventive contact element involves replacing soldering pin 30 by a soldering tongue 32 (FIGS. 6, 7), which is expediently connected to the outer edge 25 of contact plate 22 and extends outward in the plane of the sheet metal of contact plate 22 or the edgewise-wound spring element 1. Here it is possible for connection bridge 29 to be assigned a different function, serving as an arched support leg, for example, which rests as on the cradle floor of an adapter board described further below, or serving as a handling part when an adapter board is assembled.

Figure 3:
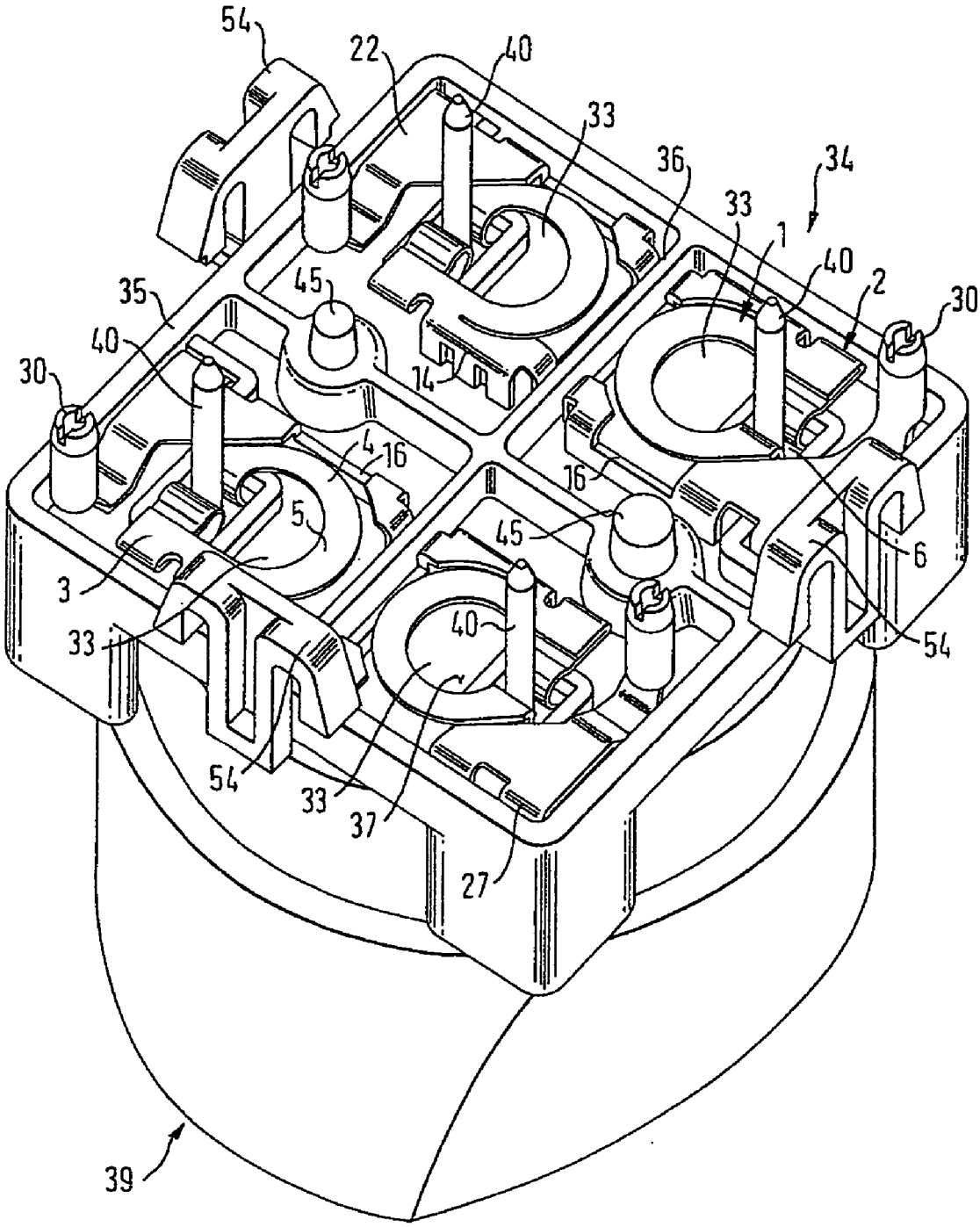
FIG. 3. is a perspective top view of an inventive adapter board placed on a servomotor with four inventive contact elements mounted on the adapter board.
Figure 4:
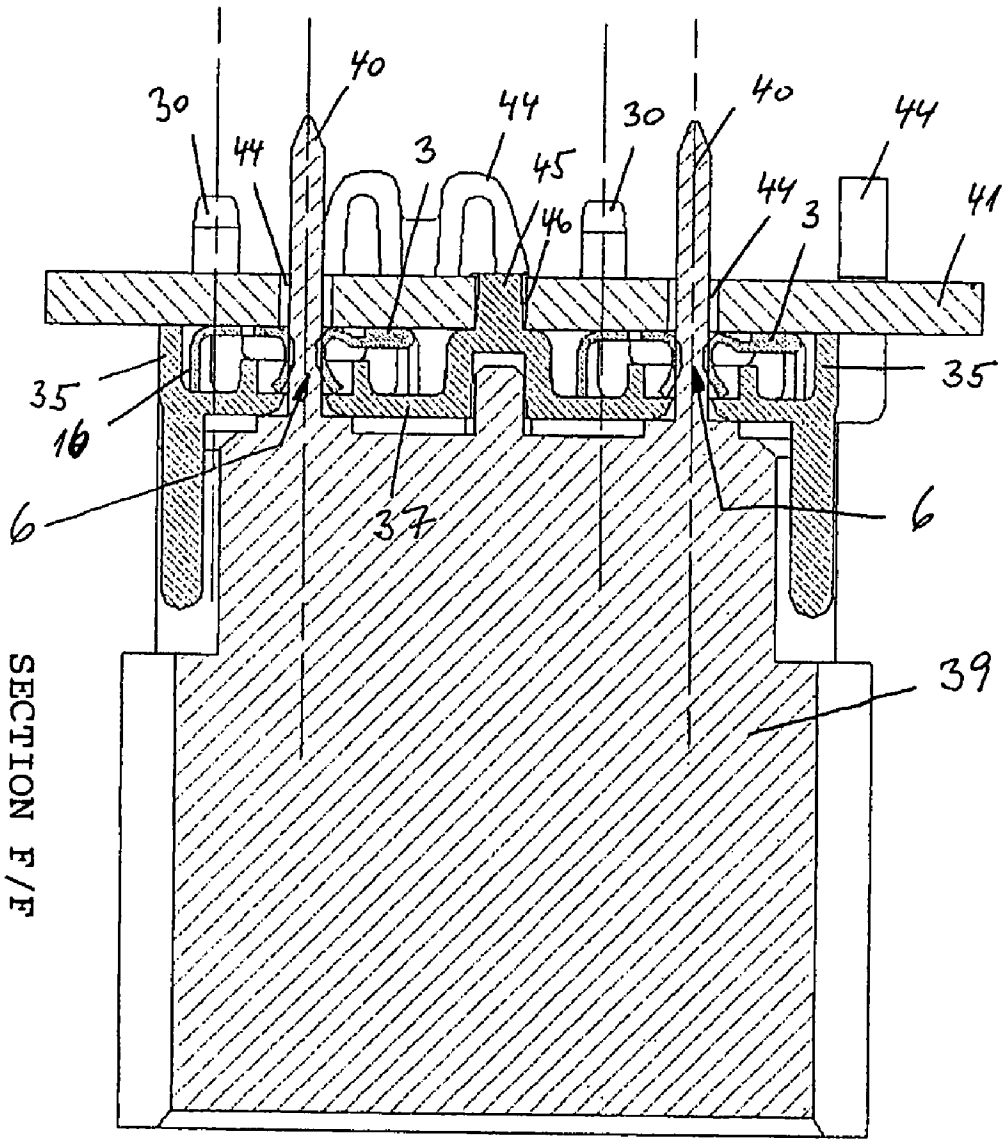
FIG. 4. is a section through two points of contact of the combination of servomotor, inventive adapter board, two inventive contact elements, and a printed circuit board.
Figure 5:
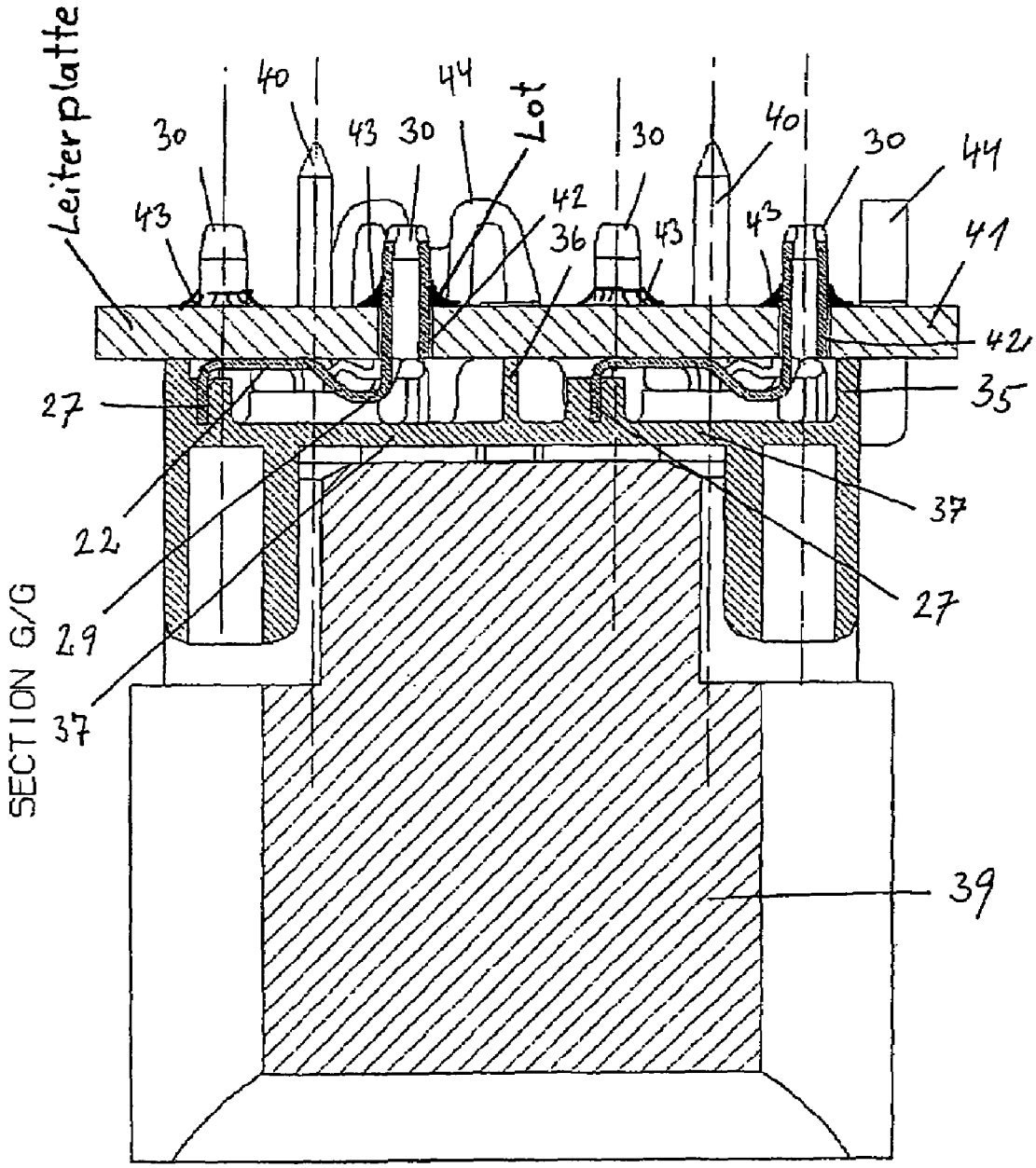
FIG. 5. is a section through two soldered joints of the combination shown in FIG. 4.

A preferred use of the inventive contact element is shown in FIGS. 3, 4, and 5. Here it is preferable for four inventive contact elements to be arranged so that each swings freely in a rectangular, preferably square, holding cradle 33 of an adapter board 34.

The holding cradles 33 are partitioned off by outer edge bars 35 and inner edge bars 36 which are of equal height, and one cradle floor 37 apiece, each retaining tab 27 of an inventive contact element being tightly seated in a corresponding slit (not shown) in the cradle floor 37 near the outer edge bar, and all other parts of the contact element being arranged so that they float freely and thus swing freely, that is do not touch, in the respective cradle 33.

Moreover, the plug-in gaps 6 of the contact elements are located over a plug-in hole 38 provided in the respective cradle floor 37, the plug-in holes 38 being arranged in the same place in each cradle 33. Accordingly, the four contact elements are positioned in the cradles 33 in such a way that their plug-in gaps 6 are located over the plug-in holes 38 and the soldering pins 30 project out of the respective cradle.

The adapter board 34 sits latched, or fastened in another way, with its side facing away from the cradles 33 on a servomotor 39, whose four terminal pins 40 reach through the plug-in holes 38 and the plug-in gaps 6 so as to make contact with them, and extend in the same direction as the soldering pins 30.

Bars 35, 36 of cradles 33 have a printed circuit board 41 sitting on them (FIG. 4, 5), which has conduction paths (not shown) on the side facing away from the servomotor 39.

Printed circuit board 41 has penetrating holes 42 for soldering pins 30, which are soldered onto a conduction path with solder 43 (FIG. 5). Moreover, printed circuit board 41 has plug-in holes 44 to allow terminal pins 40 to reach through (FIG. 4).

Printed circuit board 41 is positioned so that it is detachably latched to adapter board 34 with latching clips 44 that are arranged around the edge on adapter board 34. Adapter board 34 itself is held by suitable means (not shown) on servomotor 39, preferably in such a way that it is tightly detachably latched to it.

Positioning pins 45 on adapter board 34 can additionally fix the position of printed circuit board 41 by plugging into corresponding positioning holes 46 in the printed circuit board 41, in particular plugging into them in a form-fit manner.

Figure 6:
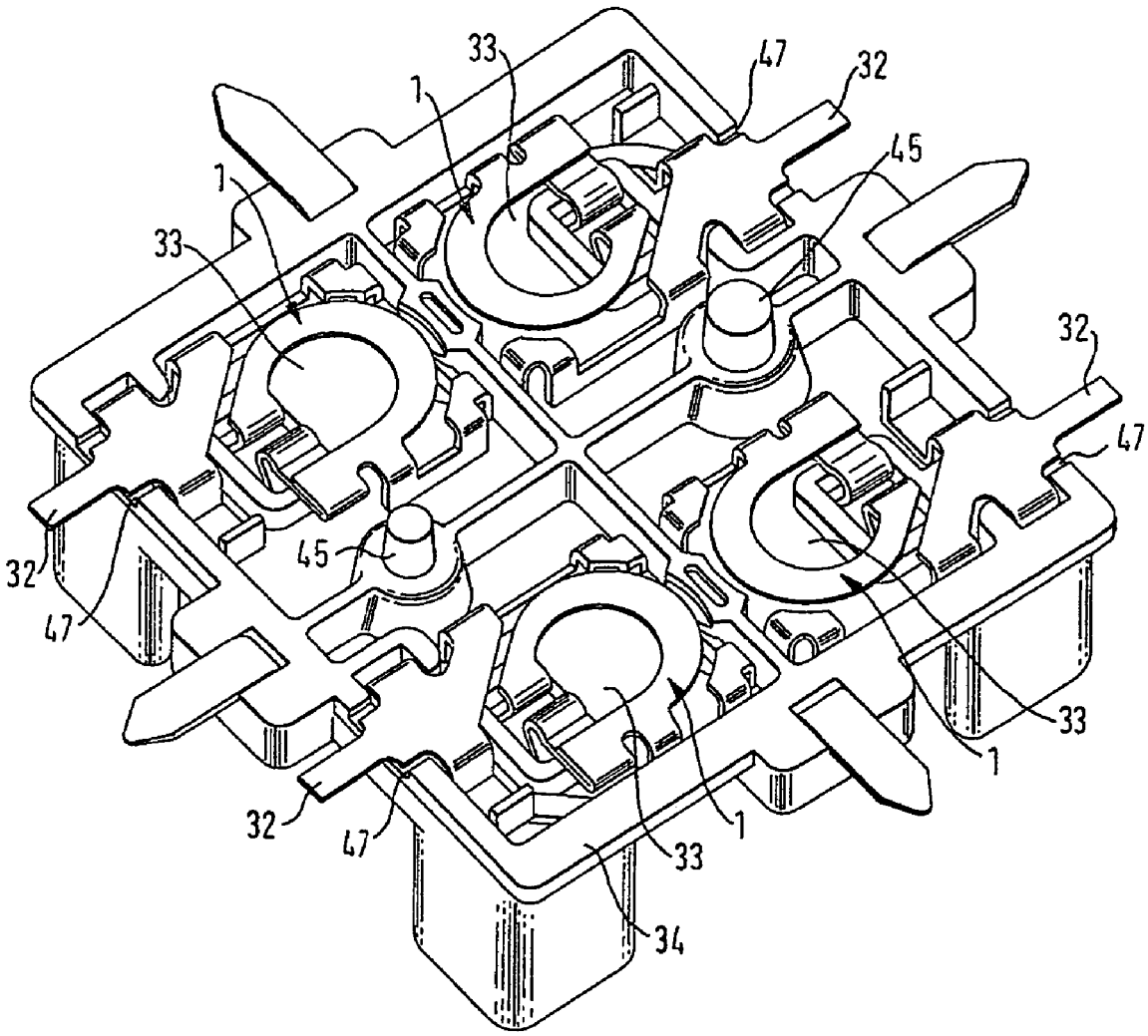
FIG. 6. is a perspective illustration of another embodiment of an inventive adapter board, with another embodiment of an inventive contact element.
Figure 7:
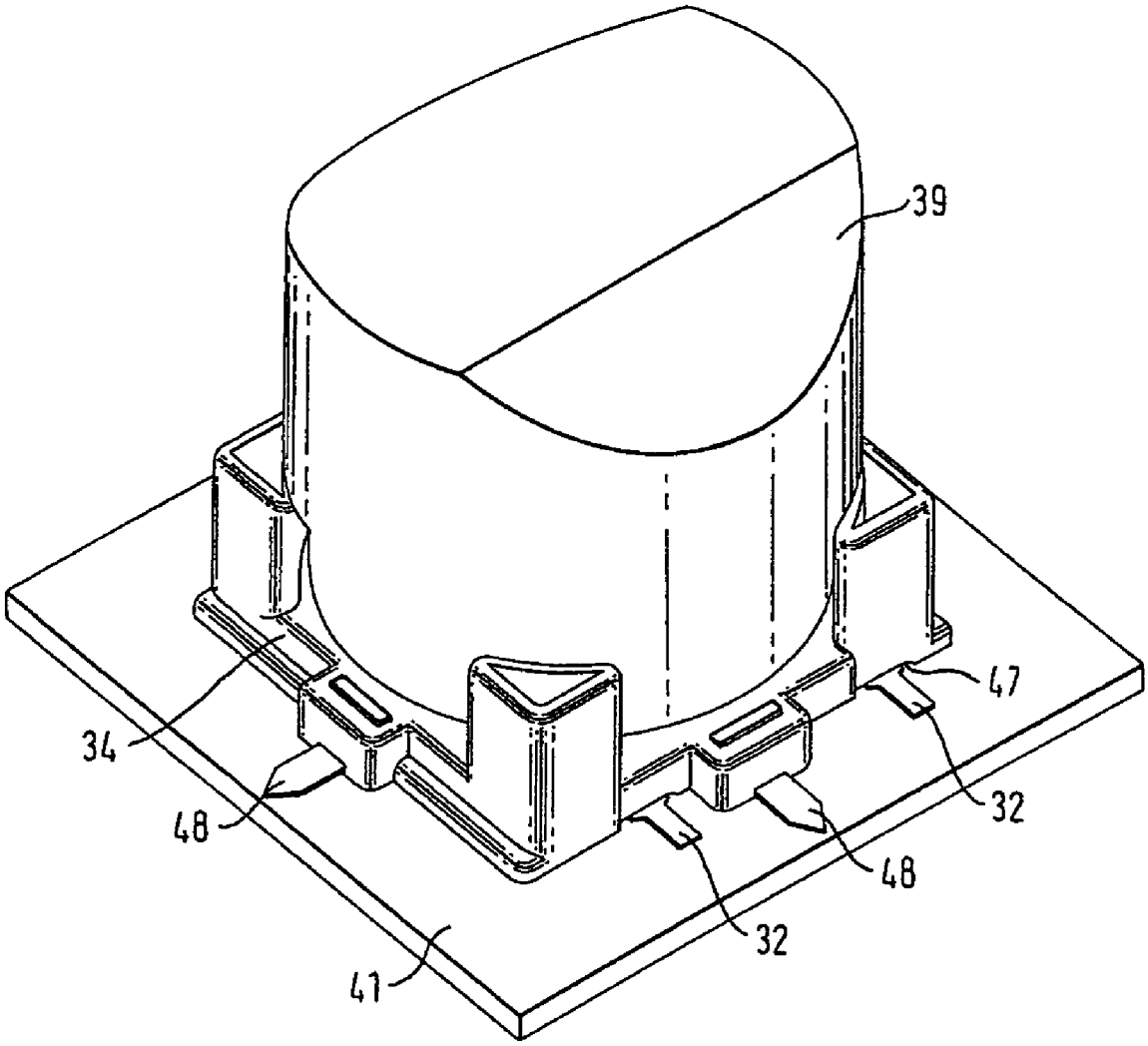
FIG. 7. is a perspective bottom view of the adapter board shown in FIG. 6 with the servomotor inserted.

Another application of the inventive contact elements is shown in FIGS. 6, 7. The contact elements are used with soldering tongues 32, which project outward from adapter board 34. Accordingly, adapter board 34 has a printed circuit board 41 set on it that projects outward from the sides of the adapter board and whose conduction paths (not shown) are on the side facing the servomotor 39 or on the side facing the adapter board 34, the soldering tongues 32 being soldered with the corresponding conduction paths (not shown). It is preferable for the adapter board 34 also to have metal fastening tabs 48, which, like soldering tongues 32, project outward from the adapter board 34, and which are soldered with metal elements, for example metal plates (not shown) that are provided for this purpose on printed circuit board 41.

The inventive contact elements consist essentially of a one-piece combination of an edgewise-wound spring element 1 that is resilient about an axis lying perpendicular to the plane of the sheet metal and a leaf spring or flat spring element 2 that is resilient about an axis lying in the plane of the sheet metal, the edgewise-wound spring element 1 ensuring high contact forces which are supported by the flat spring element 2, which acts as a reinforcing spring. Flat spring element 2 has a relatively soft characteristic curve, allowing it to compensate vibrations and other movements which act on the points of contact 8, 11 in plug-in gap 6, and to provide a permanent, constant contact force, the essential thing being that only the retaining tab 27 of each contact element is connected with the adapter board 34, while the remaining components of the contact element are arranged so that they are free swinging or free floating or free moving, and have sufficient space for spring travel.

The inventive contact-making device is simple to assemble and disassemble, so that in the case of a contact disturbance it is possible to exchange the entire contact-making device, or parts of it.

Edgewise-wound spring element 1 can also be U-shaped or made in another U-like shape, with two spring arms and one spring arm base, it being preferable for the spring arm base to be arc-shaped. In the preferred contact element shown in FIGS. 1 and 2, the two spring arms and the spring arm base of the edgewise-wound spring element each have one flat spring element assigned to them, which is held at each of its two ends by a connection bridge; however, it can also be sufficient to use only one flat spring element or two flat spring elements, and to assign each of them to a certain flat spring element or to the flat spring base. It is also possible for a flat spring element to consist of several spring bars that are arranged next to one another, for example parallel to one another.

What is claimed is:

1. Electrical contact element made of a stamped sheet metal part, characterized by a one-piece combination of an edgewise-wound spring element that is resilient about an axis lying perpendicular to a first plane of the sheet metal, with a leaf spring-like element that is oriented with respect to said first plane in at least one second plane, and connected to the edgewise-wound spring element, said leaf element is resilient about at least one axis lying in said first plane of the sheet metal, said at least one second plane of the sheet metal being oriented perpendicular to said first plane of the sheet metal of the edgewise-wound spring element, said edgewise-wound spring element defining a contact gap for a counter contact pin.

2. The contact element of claim 1, characterized in that said contact element has a solderable contact device.

3. The contact element of claim 2, characterized in that the solderable contact device 0 is arranged on the flat spring element.

4. The contact element of claim 1, characterized in that the edgewise-wound spring element has, in said first plane of its sheet metal, two spring arms arranged at a distance from one another, a spring arm base connecting the spring arms, and, opposite the spring arm base, a plug-in gap between said spring arms.

5. The contact element of claim 4, characterized in that in said plug-in gap is defined by a free end of at least one said spring arm, said end being bent out of said first plane of the sheet metal in the shape of a convex arc forming a first point of contact.

6. The contact element of claim 4, characterized in that said edgewise-wound spring element is arc-shaped, at least in the area of said spring arm base.

7. The contact element of claim 6, characterized in that the spring arm continues to be arc-shaped all the way to plug-in gap, while the other spring arm extends away from the spring arm base in a straight line.

8. Contact-making device for a servomotor having an adapter board which has a slit receiving at least one contact element of claim 1, with said contact element having a retaining tab arranged tightly seated in said corresponding slit, all other parts of the contact element being arranged so that they float freely and thus swing freely, essentially free of the adapter board and not touching it.

9. Electrical contact element made of a stamped sheet metal part, characterized by a one-piece combination of an edgewise-wound spring element that is resilient about an axis lying perpendicular to a first plane of the sheet metal, with a leaf spring-like element that is oriented with respect to said first plane in at least one second plane, and connected to the edgewise-wound spring element, said leaf element is resilient about at least one axis lying in said first plane of the sheet metal, said at least one second plane of the sheet metal being oriented perpendicular to said first plane of the sheet metal of the edgewise-wound spring element; said edgewise-wound spring element has, in said first plane of its sheet metal, two spring arms arranged at a distance from one another, a spring arm base connecting the spring arms, and, opposite the spring arm base, a plug-in gap between said spring arms; said plug-in gap is defined by a free end of at least one said spring arm, said end being bent out of said first plane of the sheet metal in the shape of a convex arc forming a first point of contact.

10. The contact element of claim 9, characterized in that said at least one spring arm has, attached to its outer edge, a contact tab that is bent back 180° out of said first plane of edgewise-wound spring element in the direction of said plug-in gap.

11. The contact element of claim 10, characterized in that on the outside of said at least one spring arm is a small distance separating a connection bridge that is bent down at a right angle in the same direction as said contact tab and is connected to said leaf spring-like element.

12. The contact element of claim 11, characterized in that the leaf spring-like element has at least one flat spring bar.

13. The contact element of claim 11, characterized in that said leaf spring-like element has three flat spring bars arranged at right angles to one another.

14. The contact element of claim 13, characterized in that one flat spring bar is connected on one end to said connection bridge and on the other end to a first corner connection bridge, and through said first corner connection bridge it is connected with a second flat spring bar, which is connected, through a second corner connection bridge, with said third flat spring bar.

15. The contact element of claim 13, characterized in that the flat spring bars are equally wide.

16. The contact element of claim 14, characterized in that the flat spring bars together form a U-shaped frame outside the edgewise-wound spring element, surrounding the latter.

17. The contact element of claim 14, characterized in that the flat spring bars are made equally long, while said one flat spring bar is somewhat shorter.

18. The contact element of claim 14, characterized in that the corner connection bridges are arranged in said first plane of the sheet metal of the edgewise-wound spring element at a small distance from it, each being bent by 90° to the respective flat spring bar and changing into the flat spring bars.

19. The contact element of claim 18, characterized in that the flat spring bars are arranged at a distance to one another, with gaps in the corner areas of the frame where they meet.

20. The contact element of claim 14, characterized in that at the free end of said leaf spring-like element, that is at the free end of said third spring bar, there is a joinder connection bridge, which changes into a contact plate arranged in said first plane of the sheet metal of the edgewise-wound spring element.

21. The contact element of claim 20, characterized in that said contact plate has a diagonally running inner edge that is separated from said at least one spring arm of edgewise-wound spring element, and includes a side edge that is parallel to said third spring bar, and an outer edge that is parallel to said second spring bar, as well as a front edge extending parallel to said side edge, said connection bridge being connected to said side edge, and said front edge being located in the area in front of said plug-in gap.

22. The contact element of claim 21, characterized in that a soldering tongue is preferably connected to said outer edge of contact plate and extends outward in the plane of the sheet metal of contact plate or the edgewise-wound spring element.

23. The contact element of claim 21, characterized in that in the direction of outer edge, said side edge has a second connection bridge, and a retaining tab, which is bent at a right angle.

24. The contact element of claim 23, characterized in that said retaining tab is located in the plane of said third flat spring bar, being aligned with it.

25. The contact element of claim 23, characterized in that said retaining tab is shaped like a Christmas tree, having retaining or latching teeth on its longitudinal edges.

26. The contact element of claim 21, characterized in that the front edge has, connected to it through a pin connection bridge, a soldering pin, which is arranged perpendicular to said first plane of the sheet metal of the edgewise-wound spring element, and in the direction opposite that of the of the flat spring bars.

27. The contact element of claim 26, characterized in that said pin connection bridge is slightly arched in the direction opposite that in which soldering pin extends.

28. Contact-making device for a servomotor having an adapter board which has slit receiving at least one contact element part, said contact element made of a stamped sheet metal part, characterized by a one-piece combination of an edgewise-wound spring element that is resilient about an axis lying perpendicular to a first plane of the sheet metal, with a leaf spring-like element that is oriented with respect to said first plane in at least one second plane, and connected to the edgewise-wound spring element, said leaf element is resilient about at least one axis lying in said first plane of the sheet metal, said at least one second plane of the sheet metal being oriented perpendicular to said first plane of the sheet metal of the edgewise-wound spring element; with said contact element part having a retaining tab arranged tightly seated in said corresponding slit, all other parts of the contact element being arranged so that they float freely and thus swing freely, essentially free of the adapter board and not touching it.

29. The contact-making device of claim 28, characterized in that four inventive contact elements are arranged so that each swings freely in a rectangular, preferably square, holding cradle of the adapter board.

30. The contact-making device of claim 29, characterized in that the holding cradles are partitioned off by outer edge bars and inner edge bars which are of equal height, and one cradle floor apiece, each retaining tab of an inventive contact element being plugged into in a corresponding slit in the cradle floor near the outer edge bar.

31. The contact-making device of claim 29, characterized in that the plug-in gap of the contact elements is located over a plug-in hole provided in the respective cradle floor, the plug-in holes being arranged in the same place in each cradle.

32. The contact-making device of claim 31, characterized in that the soldering pins project out of the respective cradle.

33. The contact-making device of claim 29, characterized in that the adapter board sits latched, or fastened in another way, with its side facing away from cradles on the servomotor, whose four terminal pins reach through the plug-in holes and the plug-in gaps so as to make contact with them.

34. The contact-making device of claim 33, characterized in that contact elements with soldering tongues are arranged on the adapter board, the soldering tongues projecting outward from the adapter board, and the adapter board having a printed circuit board set on it that projects outward from the sides of the adapter board and whose conduction paths are on the side facing the adapter board, the soldering tongues being soldered with the corresponding conduction paths.

35. The contact-making device of claim 34, characterized in that the adapter board has metal fastening tabs, which, like the soldering tongues, project outward from the adapter board, and which are soldered with metal elements (for example metal plates) that are provided for this purpose on printed circuit board.

36. The contact-making device of claim 29, characterized in that the bars of cradles have a printed circuit board sitting on them, which has conduction paths on the side facing away from the servomotor, the printed circuit board having penetrating holes for soldering pins, which are soldered onto a conduction path with solder, and the printed circuit board having plug-in holes to allow terminal pins to reach through.

37. The contact-making device of claim 36, characterized in that the printed circuit board is positioned so that it is detachably latched to adapter board with latching clips that are arranged around the edge on adapter board, adapter board being held by suitable means on the servomotor.

* * * * *